United States Patent [19]

Valikov

[11] Patent Number: 4,520,537

[45] Date of Patent: Jun. 4, 1985

[54] GOLD JEWELRY CLASP ASSEMBLY

[75] Inventor: Sioma Valikov, Van Nuys, Calif.

[73] Assignee: Harry Wolf & Sons, Los Angeles, Calif.

[21] Appl. No.: 49,544

[22] Filed: Jun. 18, 1979

[51] Int. Cl.[3] ..... A44B 19/00

[52] U.S. Cl. ..... 24/616; 24/116 A; 24/70 J

[58] Field of Search ..... 24/230 R, 230 A, 230 AK, 24/230 AL, 230 AP, 255 R, 255 BS, 255 SL, 239, 81 J, 68 J; 29/160.6; 292/175, 57

[56] References Cited

U.S. PATENT DOCUMENTS

| | | | |
|---|---|---|---|
| Re. 26,898 | 5/1970 | Geldwerth | 24/230 R |
| 329,494 | 11/1885 | Schweinfurt | 292/175 |
| 626,973 | 6/1899 | Crimmin | 24/230 R |
| 813,838 | 2/1906 | Steinberg | 24/230 R |
| 856,606 | 6/1907 | Scanlon | 24/230 R |
| 1,778,554 | 10/1930 | Grassmann | 24/230 R |
| 2,477,780 | 8/1949 | Armstrong | 29/160.6 |
| 2,952,058 | 9/1960 | Geldwerth | 24/230 R |
| 2,986,792 | 6/1961 | Wyatt | 24/230 R |
| 3,036,353 | 5/1962 | Minutoli | 24/230 R |
| 3,092,885 | 6/1963 | Guanche | 24/230 R |
| 3,145,443 | 8/1964 | Gallagher | 24/239 |
| 3,225,406 | 12/1965 | Levy | 24/230 R |
| 3,299,679 | 1/1967 | Anderson | 24/230 R |
| 3,308,517 | 3/1967 | Geldwerth | 24/230 R |
| 3,350,764 | 11/1967 | Geldwerth | 24/230 R |
| 3,359,606 | 12/1967 | Geldwerth | 24/230 R |
| 3,360,836 | 1/1968 | Geldwerth | 24/230 R |
| 3,848,299 | 11/1974 | Gray | 24/230 R |
| 4,012,063 | 3/1977 | Sherlock et al. | 292/57 |

FOREIGN PATENT DOCUMENTS

| | | | |
|---|---|---|---|
| 166910 | 5/1904 | Fed. Rep. of Germany | 24/230 R |
| 910002 | 5/1946 | France | 24/230 R |
| 3048 | of 1904 | United Kingdom | 24/230 R |

*Primary Examiner*—Victor N. Sakran

*Attorney, Agent, or Firm*—Freilich, Hornbaker, Rosen & Fernandez

[57] ABSTRACT

A gold jewelry clasp assembly is described, which includes a keeper for receiving a catch and retainer, wherein all of the elements are constructed to operate reliably over a long life time. The catch is formed of a tempered gold strip bent at its middle to form a folded leaf spring, and with one end of the strip bent into a loop around a pivoting wire retainer. The bending avoids a gold soldering operation on the strip which could degrade spring temper, and also permits welding of the retainer wire ends prior to attachment to the catch to facilitate heat sinking that minimizes loss of spring temper of the retainer. The keeper is formed of a drawn tub-shaped gold frame, with the edge that forms the opening of the tub-shaped frame, being cut away at opposite ends to leave a pair of projecting lips on opposite sides. A gold cover strip covers the opening of the frame, and the cover strip has a recess on either side that receives the frame lips in an interference fit. The frame and cover strip are joined together by gold solder lying only at the inside of the keeper along the corner where the frame and cover strip meet.

4 Claims, 9 Drawing Figures

FIG. 1
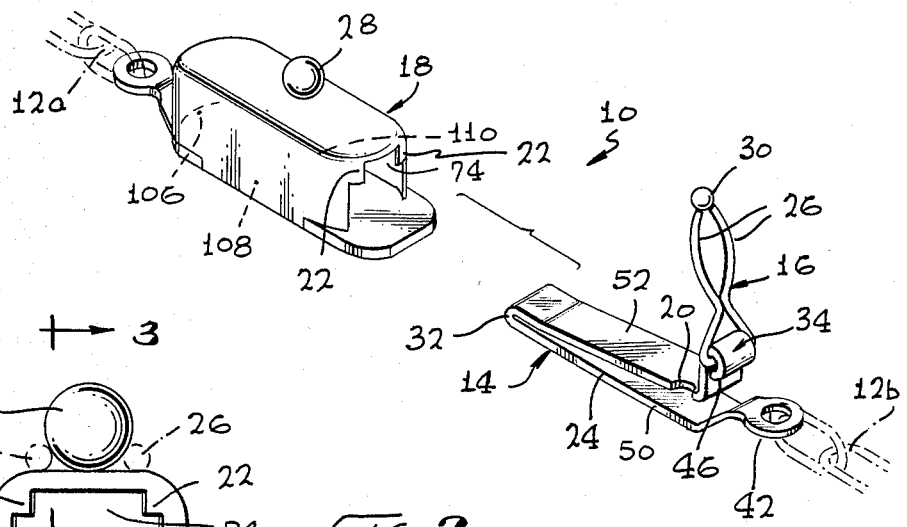
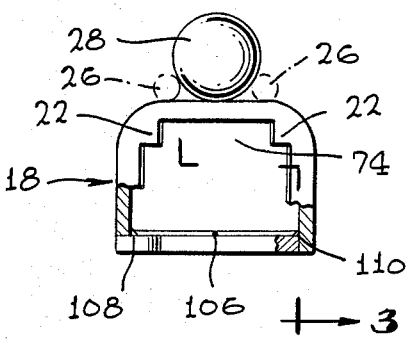
FIG. 2
FIG. 3
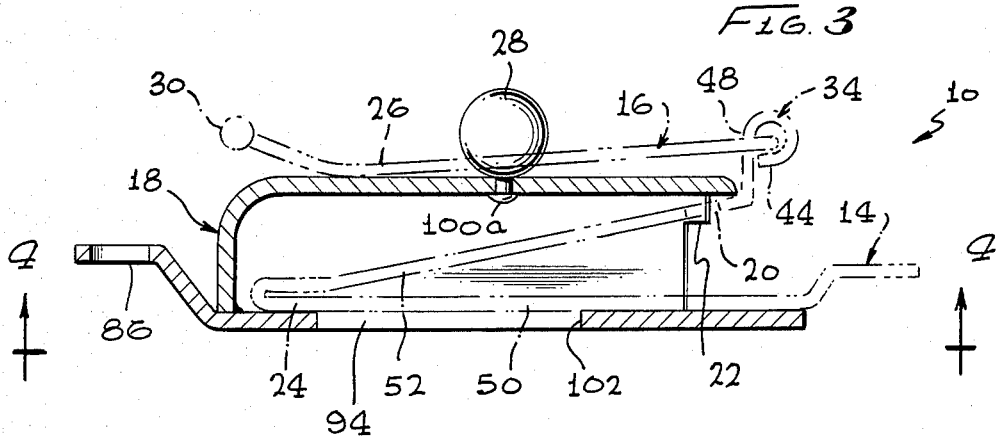
FIG. 4
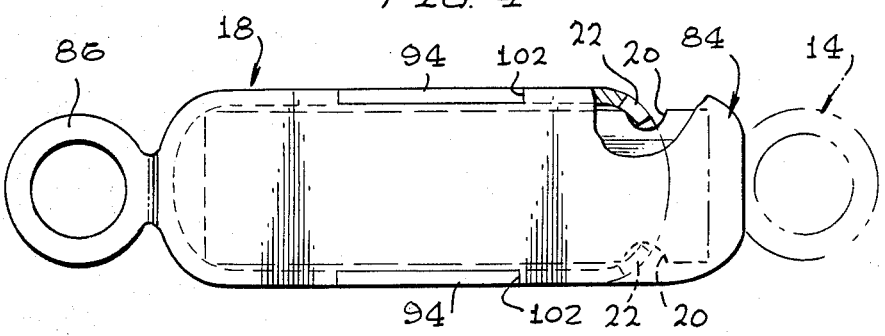

GOLD JEWELRY CLASP ASSEMBLY

DESCRIPTION OF THE PRIOR ART

One type of jewelry clasp assembly used to join the end of a necklace or other jewelry chain, includes a keeper with an opening for receiving a clasp in the form of a folded leaf spring. The keeper has a pair of latch projections at the top of its opening, so that after the catch rides past the projections it engages them, and the catch cannot be removed until the folded leaf spring thereof is compressed. The catch typically supports a retainer that is somewhat in the form of a figure 8, and that can lock onto a ball-shaped holder on the keeper. After the catch is installed in the keeper, the retainer is pivoted down, with the legs of the retainer momentarily spread apart to pass below the ball of the keeper, so that the retainer is thereafter held to the keeper. This clasp construction is easily operated, and yet can provide dual retention to securely hold valuable gold jewelry. However, the specific construction of clasps of this type has led to compromises in its reliability and the need for considerable finishing work to provide an attractive appearance.

One problem in the construction of the above type of clasp arises from the need to utilize substantially only gold in all parts of its construction, in order to permit the jewelry containing the clasp to be designated as gold, and as gold of a particular karat such as in marking it "14k". One of the problems arises from the fact that gold soldering must be conducted at a high temperature such as about 1500° F., while tempered gold begins to anneal at far lower temperatures such as 800° to 1000° F. In the construction of the catch which has a folded leaf spring, a typical prior art construction technique involves the gold soldering of a miniature tube to the end of the leaf spring, to pivotally support the retainer. Even with the application of a heat sink to the leaf spring, it is very difficult to prevent the leaf spring from heating up to its annealing temperature when the end of the leaf is being heated to its soldering temperature. This is particularly true in the case of gold, which is an extremely good conductor of heat. As a result, the leaf springs of prior art catches have reduced resilience, and therefore reduced reliability. Some prior art catches have utilized white gold at the folded leaf spring, since the alloys in white gold are more resistant to annealing, but a noticeable reduction in resilience still occurs.

After the miniature tube has been installed on prior art leaf springs, gold wire has been threaded through the tube, the gold wire has been bent to a generally figure 8 configuration, and the ends of the gold wire have been melted together. The melting of the ends can greatly anneal the gold wire, so that it loses its spring temper. While the spring temper of the gold wire is not as important as for the folded leaf spring, it is nevertheless of some significance. It is difficult to apply a good heat sink to the wire, because of its attachment to the catch.

Prior art keepers have typically been formed by folding a sheet of metal so as to produce a receptacle for the catch. The folding was performed to leave a pair of latch projections that directly engage the catch, and with the latch projections soldered in place to help resist forces applied by the catch. However, soldering of an extremely small latch projection is less than completely reliable under the large forces that may be applied by a catch. Also, the various soldering operations can detract from the overall appearance of the clasp unless costly finishing operations are applied to remove irregular solder seams.

SUMMARY OF THE INVENTION

In accordance with one embodiment of the present invention, a gold jewelry clasp is provided, which is highly reliable, and can be constructed at low cost and attractive appearance. The clasp includes a catch that can be received in a keeper, and a retainer pivotally mounted on the catch to lock onto the keeper. The catch is formed of a unitary strip of gold alloy having a spring tempered middle portion forming a folded leaf spring. An end of the strip is bent into a loop around a wire pivot portion of the retainer, to complete the catch end without the need for gold alloy soldering that could destroy the spring temper of the folded leaf spring. The keeper includes a main frame in the form of a tub, and a cover strip covering the opening in the tub. The edge of the tub-shaped frame is cut away at opposite ends to leave a protruding lip on either side, and the cover strip has a recess on either side for receiving the protruding lips in an interference fit. The frame and cover strip are permanently joined by gold solder applied substantially only at the inside of the frame at the corner where the cover strip and frame meet.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a clasp of the invention, shown prior to engagement of the parts thereof.

FIG. 2 is an end elevation view of the keeper of the clasp of FIG. 1.

FIG. 3 is a view taken on the line 3—3 of FIG. 2, and also showing, in phantom lines, the catch and retainer in a fully installed configuration.

FIG. 4 is a view taken on the line 4—4 of FIG. 3.

DESCRIPTION OF THE PREFERRED EMBODIMENT

Figure 5:
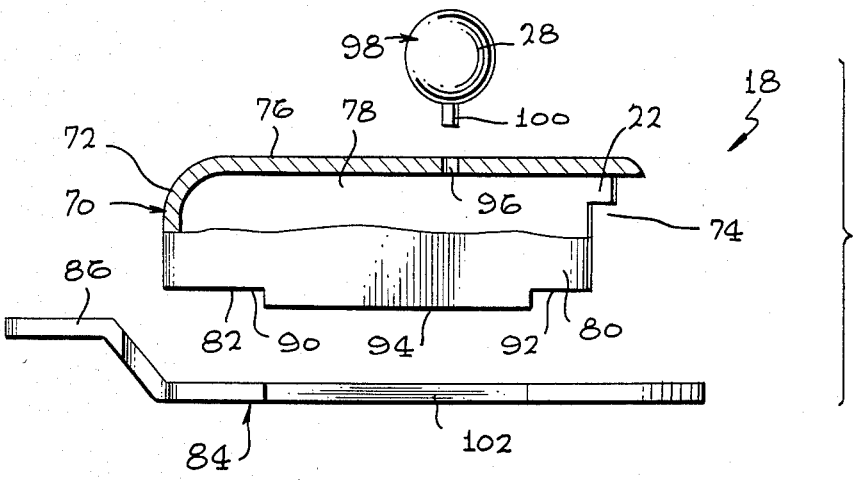
FIG. 5 is an exploded side view of the keeper of FIG. 3.

FIG. 1 illustrates a gold jewelry clasp 10 which can be utilized to fasten the ends 12*a*, 12*b* of a gold chain such as that of a necklace or bracelet. The clasp includes a catch 14 that pivotally supports a retainer 16, and a keeper 18 that can attach to both the catch and retainer. As shown in FIG. 3, connection of the clasp can be accomplished by inserting the catch 14 into the hollow keeper until ledges 20 on the catch pass across and spring up behind latch projections 22 on the keeper. This prevents withdrawal of the catch 14 until a folded leaf spring 24 thereof is compressed while the catch is pulled out from the keeper. After the catch has been installed in the keeper, the retainer 16 can be pivoted down until a pair of arms 26 thereon pass below a ball-shaped holder 28 on the keeper. The arms 26 are slightly closer together than the diameter of the ball 28, so that the retainer will not lift off until a person applies a definite upward force to a tiny ball-shaped handle 30 on the retainer. The mechanism is very small, with a clasp constructed as shown in the drawing having a keeper 18 with a length of about 14 millimeters.

In order to comply with the marking of a piece of jewelry that it is "14K", or of 14 karat gold, it is necessary that substantially all parts be formed of a gold alloy, which may herein be referred to as gold. The catch 14 can be formed of a strip of gold which has been worked, as by stamping, to provide a spring temper. The strip then can be folded at the middle 32 to provide a folded leaf spring. The need to pivotally support the retainer 16 at one end of the strip has led, in the prior art, to partial destruction of the spring temper and consequent degradation of the catch. In the prior art, a section of miniature gold tubing was cut to a length equal to the width of the gold strip that forms the catch, and this tube was gold soldered onto the end of the strip. The gold soldering operation caused annealing of the folded leaf spring, and consequent loss of its springiness and reliability as part of the catch.

The destruction of spring temper during gold soldering arises from the extremely high thermal conductivity of gold, in combination with the relatively high gold soldering temperature in comparison with the gold annealing temperature. Gold soldering, utilizing a gold soldering alloy to attach a gold object, requires a soldering temperature of about 1500° F. The 14K gold of the catch 14 begins to anneal at a temperature of about 800° to 1000° F. Thus, to solder a small tube to the end of the catch, without annealing the folded leaf spring thereof, would require maintaining the folded leaf spring of the catch at least 500° F. below the temperature at which the end of the catch was heated for soldering. Gold has an extremely high thermal conductivity, so that it is very difficult to maintain this temperature difference so as to cool the folded leaf spring below its annealing temperature. It might be possible to apply a heat sink of a material of high thermal conductivity such as silver, to the gold leaf spring during soldering, but even silver has only a slightly better thermal conductivity than gold, and silver would become soft and deform at the gold soldering temperature. One solution utilized in the prior art was to employ white gold in the folded leaf spring, in as much as the annealing temperature of white gold is somewhat higher than that of yellow gold, but it has been found that significant annealing of the tempered leaf spring still occurred, to an extent that noticeably decreased the springiness of the catch.

Figure 6:
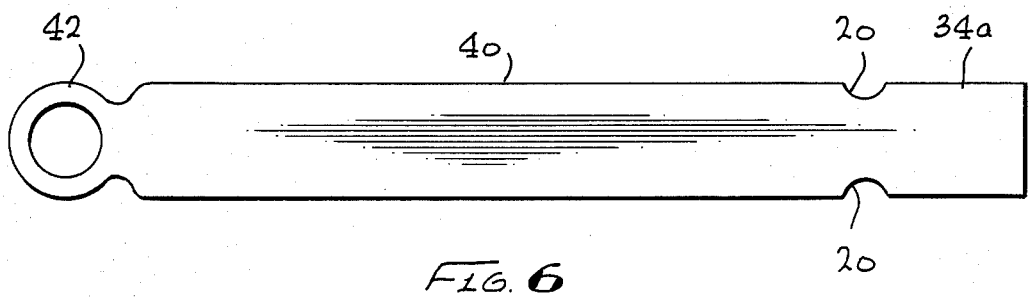
FIG. 6 is a plan view of a strip utilized to form the catch of FIG. 1, shown in one stage of its manufacture.
Figure 7:
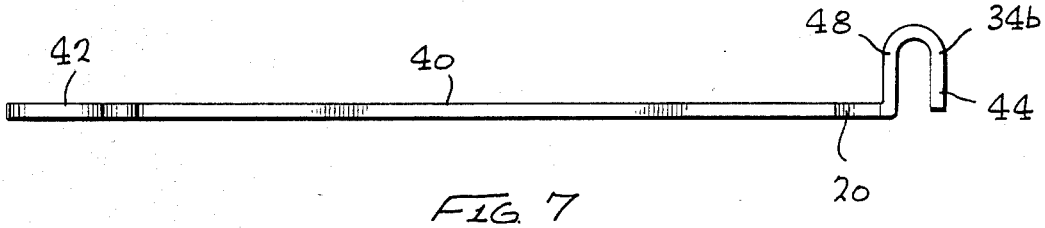
FIG. 7 is a side elevation view of the catch strip of FIG. 6, but shown at a later stage in its fabrication.
Figure 9:
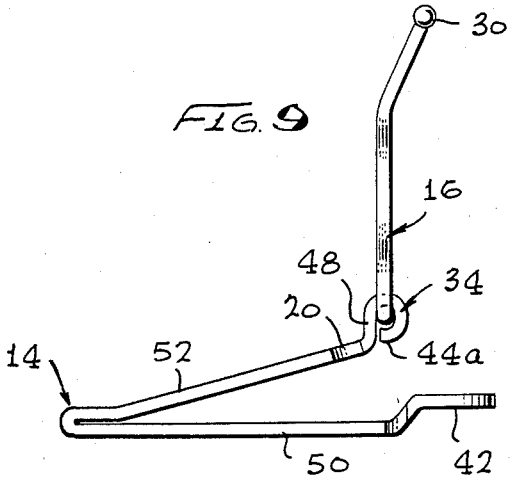
FIG. 9 is a side elevation view of the catch of FIG. 1.

In accordance with the present invention, the catch 14 is formed to hold the retainer 16, without applying high temperatures to the catch which would anneal the folded leaf spring. This is accomplished by folding the end portion 34 of the retainer around a middle portion of the keeper, in a loop that securely holds the keeper in place. FIG. 6 shows a spring-tempered strip 40 of gold, which is formed with an eyelet 42 at one end opposite the keeper-holding end 34*a*. In a first operation on the strip, shown in FIG. 7, the end portion 34 is deformed to a half loop at 34*b*. The pivot portion 46 of the keeper is then inserted in the loop, and the extreme tip 44 of the loop is then folded 90° to the position shown at 44*a* in FIG. 9, around the keeper. This double folded operation pivotally mounts the keeper on the catch in a secure manner, without the application of high temperatures that could detract from the leaf spring. A relatively large force may be applied to the keeper 16 tending to pull it away from the catch 14 in a situation such as that shown in FIG. 3, and if the catch 14 were accidentally released only the keeper 16 would hold the clasp together to prevent loss of the gold jewelry. In that case, tension in the chain would force the pivot portion 46 of the keeper against the inner side 48 of the loop formed in the catch. Such force on the inner side 48 of the loop would not tend to open the loop. In fact, the only way for the keeper 16 to be pulled so as to tend to deform the extreme end 44 of the catch so as to open the loop, would be if the keeper 16 were to extend downwardly. However, the eyelet 42 at the other end of the catch prevents the keeper 16 from pivoting far enough to extend down.

It may be noted that the eyelet 42 (FIG. 9) is bent upwardly out of the plane of the lowermost leaf portion 50 of the folded leaf spring, to help center the chain on the catch. The eyelet 42 is bent up at a location slightly beyond the loop 34, to permit the loop 34 to be bent down until the two leaf portions 50, 52 of the folded leaf spring engage one another, and with the loop 34 lying behind the eyelet 42.

Figure 8:
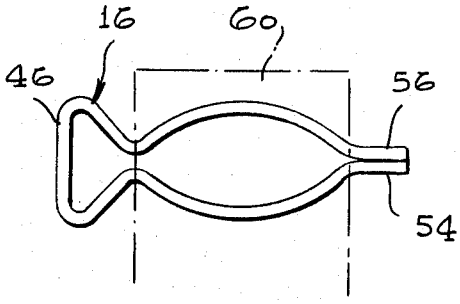
FIG. 8 is a plan view of the retainer of FIG. 1, shown in one stage of its fabrication.

The construction of the catch with a folded-over end, also facilitates construction of the retainer, which is shown in FIG. 8. The retainer 16 is formed of a gold wire which is bent to a somethat figure 8 shape, as shown. After the folding operation (or possibly before it), the ends 54, 56 of the wire are melted together to form the ball-shaped handle 30. This operation can be conducted, as indicated in FIG. 8, by tightly holding the keeper between a pair of jaws 60 of a plier's device which also serves as a heat sink. Then, a brief application of a welding torch device is applied to the ends 54, 56 to melt them together. It is often possible to apply the welding torch for a briefer period then would be required for soldering two parts together, to minimize heating of the retainer 16. However, it is found that some annealing of the retainer 16 occurs. Although the springiness of the retainer 16 may not be of the highest level, the relatively small deflection of the retainer arms during press down and lift off from the ball 28 of the keeper, allows the retainer to serve reliably even with a slightly reduced temper. In the prior art, where the pivot portion 46 of the retainer had to be received in a short gold tube, the bending of the retainer to its figure 8 configuration, and welding of the retainer ends, all had to be accomplished after the gold wire of the retainer was installed on the catch. This made the bending of the retainer to its configuration and the handling of it more difficult, so that the effective application of a heat sink to the retainer during welding of the retainer ends was more difficult. The use of a folded-over end on the catch 14, therefore also facilitates construction of the retainer 16.

The keeper 18 (FIG. 5) includes a main frame 70 which may be described as in the form of a trough with a closed end 72, or a tub with an open end 74, and having a base 76 and two side walls 78, 80. The opening 82 in the frame which lies opposite the base 76, is covered by a cover strip 84. The cover strip 84 is formed of a gold strip with an eyelet 86 at one end for attaching to a chain.

The main frame 70 is formed by drawing an oval-shaped sheet of gold into an elongated tub shape. The edge around the opening 82 is then milled flat, and the opposite end portions 90, 92 of the edge are milled away to leave projecting bosses or lips 94 on either side wall of the frame. Following this, the open end 74 is formed by a broach-like process wherein a cutter cuts away the end to leave the opening 74. The opening has a greater width between the bottom of the frame and a location spaced below the base 76, than at a higher location to near the level of the base 76, to leave the latch projections 22 (FIG. 2). A hole 96 (FIG. 5) is then formed in the middle of the base wall to receive a holder device 98 that includes the ball-shaped holder 28.

The holder device 98 is formed by casting, by forming wax models of the holder device and utilizing them in a lost wax centrifugal casting process to produce a gold holder device. The holder device has a more even and attractive shape than can be produced by merely applying heat to a wire to form a ball at the end. The holder device 98 is installed by inserting a stem 100 thereof through the hole 96 and then deforming the lower end 100*a* of the stem to the configuration shown in FIG. 3. This provides positive holding of the head or ball 28, which is more reliable than the prior art technique of soldering a ball onto a keeper wall.

After the holder device has been installed on the main frame 70 (FIG. 5), the cover strip 84 can be applied. The cover strip 84 is formed of a gold strip having the same width as the main frame 70, but with a pair of recesses 102 formed at either side, as shown in FIG. 4. The length of the recesses 102 in the cover strip are made very slightly less than the length of the projecting lips 94 on the main frame. As a result, when the main frame 70 is pressed against the cover strip 84, it is held in an interference fit therewith. Following such assembly, the main frame 70 and cover strip 84 are soldered together to more securely hold them together. However, the soldering is applied only to the inside of the keeper 18, so that no unslightly soldering line is formed which can detract from the appearance of the keeper.

The soldering of the cover strip 84 (FIG. 2) to the main frame 70 is accomplished by projecting the tip of a solder applicator through the front opening 74 of the keeper and applying three dots of gold solder to the inside of the keeper. The three dots are applied at the locations 106, 108, 110 shown in FIGS. 1 and 2, at the corners formed by the intersection of the cover 84 and the side walls of the main frame 70 where they meet. Following the application of the solder, the entire keeper is placed in a furnace that heats the keeper to the melting temperature of the solder, such as 1500° F. The solder dots can flow into tiny cracks at the corner locations where the cover strip 84 and main frame 70 meet, the solder being drawn into these cracks by capillary action. Accordingly, when the keeper has cooled, a long thin line of solder will have been applied to the inside of the keeper along substantially all of the inside corner thereof to securely hold the cover strip to the main frame. Although the furnace heating of the keeper 18 anneals it, there are no spring parts in the keeper so that such annealing does not affect the functioning of the clasp.

Thus, the invention provides a clasp and method for making it, which can result in a highly reliable clasp of attractive appearance, and which enables the clasp to be constructed at relatively low cost. The catch of the clasp is formed and attached to the retainer, without applying soldering temperatures to the catch which could impair its spring temper, by folding an end of the catch to a closed loop around the pivot portion of the retainer. This also permits the retainer to be fully formed before its attachment to the catch. The keeper can be formed of a drawn tub-shaped main frame whose opening is covered by a cover strip. The main frame can be formed with a pair of projecting lips, and the cover strip can be formed with a pair of recesses slightly shorter than the lips so that the cover strip is held by an interference fit to the frame of the keeper. The cover strip and main frame can be soldered together by applying gold solder dots to the inside of the keeper at the corners where the main frame and cover strip meet. Heating of the keeper then permits the solder dots to melt into the corners to securely hold the cover strip to the keeper. The minimizing of different parts that must be soldered together, not only avoids or reduces the annealing of spring parts, but also increases the reliability of the clasp by minimizing the number of solder joints and especially of joints which must be hand soldered and which may be unreliable if not performed in an expert manner, while also minimizing hand labor and avoiding irregularities that can detract from the appearance of the clasp.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A gold jewelry catch assembly, comprising:

a catch; and a retainer which includes a wire with a pivot portion pivotally held on said catch;

said catch being formed of a unitary strip of gold alloy, said strip having a middle portion which is folded over to form a folded leaf spring and said strip being of a spring temper along said middle portion, said strip having an eyelet at a first strip end and being bent into a loop at the other second end around said wire pivot portion, whereby to complete the ends of the strip without a soldering operation which could heat and anneal the leaf spring.

2. A keeper for a jewelry catch assembly, comprising:

a main frame generally in the shape of a trough with a base, opposite end walls, and a pair of side walls, said frame having an opening opposite the base, and said frame having an opening in one of said walls for receiving a catch;

a cover strip extending along the length of said trough to cover the opening opposite the base, and being joined to the frame;

said frame having an edge forming said opening which lies opposite said base, said edge being cut away at selected locations to leave a pair of lips, with each lip projecting further from the base than the cut away locations by approximately the thickness of said cover strip; and said cover strip having a pair of recesses positioned to closely receive said lips.

3. A keeper for a jewelry catch assembly, comprising:

a main frame generally in the shape of a trough with opposite ends and with a base, a pair of side walls and an opening opposite the base, and said trough having a largely open front end for receiving a catch and a substantially closed rear end;

a cover strip extending along the length of said trough along the opening thereof to cover it, and being joined to the frame, said cover strip having a rear end extending beyond the rear end of said main frame and forming an eyelet for attachment to a chain;

said base of said frame having a hole; and a holder device having a ball and stem, said ball nestled in said hole, said stem extending through said hole, and the stem end opposite the ball being deformed to a diameter larger than said hole.

4. A keeper for a jewelry catch assembly, comprising:

a main frame generally in the shape of a trough with opposite ends and with a base, a pair of side walls and an opening opposite the base, and said trough having a largely open front end for receiving a catch and a substantially closed rear end; and a cover strip extending along the length of said trough along the opening thereof to cover it, and being joined to the frame, said cover strip having a rear end extending beyond the rear end of said main frame and forming an eyelet for attachment to a chain;

said frame has an edge forming said opening which lies opposite said base, said edge being cut away near opposite ends of said trough to leave a lip along each side wall, with each lip projecting further from the base than either end of said frame by approximately the thickness of said cover strip; and said cover strip has a recess at either side which can receive one of said slips in an interference fit therewith.

* * * * *